US011185177B2

(12) United States Patent
Castro

(10) Patent No.: US 11,185,177 B2
(45) Date of Patent: Nov. 30, 2021

(54) ASSISTIVE APPARATUS FOR SIDE SLEEPERS

(71) Applicant: Shoulder-eeze, LLC, Corpus Christy, TX (US)

(72) Inventor: Enrique Castro, Corpus Christy, TX (US)

( * ) Notice: Subject to any disclaimer, the term of this patent is extended or adjusted under 35 U.S.C. 154(b) by 381 days.

(21) Appl. No.: 16/101,506

(22) Filed: Aug. 12, 2018

(65) Prior Publication Data

US 2019/0045951 A1 Feb. 14, 2019

Related U.S. Application Data

(60) Provisional application No. 62/675,187, filed on May 23, 2018, provisional application No. 62/545,267, filed on Aug. 14, 2017.

(51) Int. Cl.
*A47G 9/10* (2006.01)
*A47C 20/02* (2006.01)

(52) U.S. Cl.
CPC ..... *A47G 9/109* (2013.01); *A47C 20/02* (2013.01); *A47G 2009/1018* (2013.01)

(58) Field of Classification Search
CPC ..... A47C 16/00; A47C 20/02; A47C 20/026; A47G 9/109; A47G 2009/1018
USPC ..... D6/601
See application file for complete search history.

(56) References Cited

U.S. PATENT DOCUMENTS 2,295,906 A 9/1942 Lacour
2,835,905 A 5/1958 Helgi
3,757,364 A 9/1973 Downing
3,757,365 A 9/1973 Kretchmer
D247,312 S 2/1978 Zeiss
4,118,813 A 10/1978 Armstrong
4,473,913 A 10/1984 Ylvisaker
4,536,905 A 8/1985 DeSantis
4,550,458 A * 11/1985 Fiore ..... A47C 7/383 297/393
4,821,355 A * 4/1989 Burkhardt ..... A47G 9/10 5/636
5,360,017 A 11/1994 Austin
5,457,832 A 10/1995 Tatum
5,479,667 A 1/1996 Nelson et al.
D388,648 S 1/1998 Bates
6,003,177 A * 12/1999 Ferris ..... A61F 5/01 5/636
D418,711 S * 1/2000 Mettler ..... D6/601
D434,936 S 12/2000 May
D471,050 S * 3/2003 Haubner ..... D6/601
(Continued)

OTHER PUBLICATIONS

Shoulder Relief Pillow: announced unknown, [online], [site visited Apr. 27, 2019], Available from Internet, https ://www .shoulderrel iefpi llow .com/product-page/shoulder-eeze-pil low-small (Year: 2019).

*Primary Examiner* — Nicholas F Polito
(74) *Attorney, Agent, or Firm* — Shah IP Law, PLLC

(57) ABSTRACT

A sleep aid apparatus for assisting side-sleepers is disclosed herein. The apparatus greatly reduces the amount of pressure that is typically experienced by side-sleepers on the inferior portions of their upper body and their arms. The inventive apparatus alleviates these problems by improving cervical nerve decompression, reducing pressure on the side-sleeper's spine, and improving neurovascular circulation in the side-sleeper's arms.

7 Claims, 3 Drawing Sheets

(56) References Cited

U.S. PATENT DOCUMENTS

| | | | | |
|---|---|---|---|---|
| 6,913,019 | B2 * | 7/2005 | Johns | A47G 9/10 128/845 |
| 7,165,279 | B1 | 1/2007 | Georgescu | |
| D540,096 | S | 4/2007 | Fuksas et al. | |
| D541,096 | S | 4/2007 | Georgescu | |
| D553,412 | S * | 10/2007 | Cupo | D6/601 |
| D561,511 | S * | 2/2008 | Peart | D6/601 |
| D595,529 | S * | 7/2009 | Deetsch | D6/601 |
| 8,069,515 | B1 | 12/2011 | Tingey | |
| D668,092 | S * | 10/2012 | Davis | D6/601 |
| D690,535 | S * | 10/2013 | Huang | D6/601 |
| 8,806,684 | B1 * | 8/2014 | Ortega | A47G 9/109 5/636 |
| D728,272 | S * | 5/2015 | Zimmerman | D6/601 |
| 9,138,084 | B1 * | 9/2015 | Namolovan | A47G 9/007 |
| D769,029 | S | 10/2016 | Okwumabua | |
| 9,615,682 | B1 | 4/2017 | Maddocks et al. | |
| D815,861 | S * | 4/2018 | Kassab Arabo | D6/601 |
| D818,289 | S * | 5/2018 | Facco | D6/601 |
| D845,033 | S | 4/2019 | Berg | |
| 10,362,888 | B1 * | 7/2019 | Barcohana | A61H 1/0296 |
| D858,143 | S * | 9/2019 | Tu | A47C 7/383 D6/601 |
| D873,051 | S * | 1/2020 | Chen | D6/601 |
| D907,942 | S * | 1/2021 | You | D6/601 |
| 2008/0282474 | A1 | 11/2008 | Hsin | |
| 2012/0186022 | A1 * | 7/2012 | Navarro | A47G 9/10 5/644 |
| 2013/0098364 | A1 * | 4/2013 | Davis | A61G 7/072 128/206.21 |
| 2013/0232693 | A1 | 9/2013 | Myers | |
| 2015/0074910 | A1 | 3/2015 | Bieniek et al. | |
| 2018/0303259 | A1 | 10/2018 | Glatt | |
| 2020/0093296 | A1 * | 3/2020 | Kaminskiy | A47G 9/1081 |

* cited by examiner

ASSISTIVE APPARATUS FOR SIDE SLEEPERS

CROSS-REFERENCE TO RELATED APPLICATIONS

This application claims priority to U.S. Provisional Patent Application Ser. No. 62/545,267, filed Aug. 14, 2017, entitled "PILLOW SUPPORT" the entire content of which is incorporated herein by reference.

This application also claims priority to U.S. Provisional Patent Application Ser. No. 62/675,187, filed May 23, 2018, entitled "Assistive Apparatus for Side Sleepers" the entire content of which is incorporated by reference.

BACKGROUND

Field of the Art

This invention relates generally to physical health of the mammalian body, and more specifically to sleep-aid apparatuses that help humans sleep better by minimizing pain and discomfort that may be otherwise associated with sleeping.

Discussion of the State of the Art

When people with cervical, thoracic, and shoulder injuries sleep on their sides, they often experience pain radiating from those areas into the upper extremities in the form of numbness, burning, and tingling. The pain is typically caused by the downward compression of the shoulders, which causes the cervicothoracic spine to become misaligned, and results in traction and/or compression of the neurovascular and soft tissue elements in those areas. Side sleepers who suffer from this type of injury are therefore unable to sleep for short or extended periods of time without additional pain, which can often be severe.

Traditionally, sufferers have tried to reduce the impact of these issues by using various types of head and neck pillows, which support or cradle the head in various ways in an effort to align the spinal vertebrae. However, these methods and related apparatuses are generally ineffective at cervical nerve decompression, at reducing the pressure on one's spine, or improving neurovascular circulation in one's arms.

SUMMARY

Accordingly, the inventor has conceived and reduced to practice, a sleep-aid apparatus that helps side sleepers sleep better by improving cervical nerve decompression, reducing pressure on the sleeper's spine, and improving neurovascular circulation in the sleeper's arms. In one exemplary embodiment, the inventive apparatus comprises a central support element, a shoulder support element, a mid-torso support element, and a cavity. These elements support a sleeper's shoulder, spine, and torso, while also reducing pressure on the sleeper's arm when the sleeper sleeps on his or her side while using the inventive apparatus by placing the inventive apparatus against his or her torso.

According to one aspect, a user may use the inventive apparatus by placing it against his or her upper body. For example, the user may place the apparatus such that the central support element extends longitudinally from the user's mid-clavicular line to the user's central mid-torso. In such a case, the shoulder support element extends from the user's mid-clavicular line to the lateral border of the user's shoulder, and the mid-torso support element extends from the user's central mid-torso to the outer portion of the user's mid-torso. The cavity is situated between the shoulder support element and the mid-torso support element such that the user may place his or arm through the cavity when the apparatus is placed against his or her torso in the manner described above.

FIG. 1 illustrates one exemplary embodiment of the inventive apparatus 100, and an exemplary method for using it. Specifically, in FIG. 1, the inventive apparatus comprises a central support element, two shoulder support elements, two mid-torso support elements, and two cavities. As shown in FIG. 1, the central support element extends longitudianlly from the user's mid-clavicular line to the user's central mid-torso. The two shoulder support elements extend from the user's mid-clavicular line to the lateral borders of the user's shoulders. The two mid-torso support elements extend from the user's central mid-torso to the outer portions of the user's mid-torso. The two cavities are situated between the shoulder support elements and the mid-torso support elements such that the user may place his arm through each cavity when the apparatus is placed against the user's torso in the manner described above.

When used in this manner, and in a side sleeping position, the inventive apparatus reduces cervical nerve traction and/or compression. Specifically, the central structural element and the shoulder support elements reduce pressure on the user's shoulders and spine. Moreover, the various elements of the inventive apparatus improve the alignment of the spine and reduce traction and/or compression of the neurovascular and soft tissue elements around the shoulders, the spine, and the arms, by distributing and reducing downward pressure on various portions of a user's upper body while the user is sleeping on his or her side. As a result of this weight distribution, pressure reduction, and spinal alignment, the inventive apparatus improves neurovascular circulation in and around the user's upper extremities.

One feature of the inventive apparatus disclosed herein is that it is versatile. The inventive apparatus does not significantly reduce the user's mobility, or his ability to move around, while using the inventive apparatus. For example, when used in the manner described above, a user may easily turn from one side to another without removing or re-adjusting the apparatus. As such, the inventive apparatus does not interfere, or minimally interferes, with a user's sleep. Moreover, the inventive apparatus accommodates a variety of different user preferences. For example, a user can use the apparatus while sleeping on his left or right side.

One feature of the inventive apparatus disclosed herein is that is it compatible with various other sleeping accessories, such as blankets, neck pillows, and pillow cases. A user may, for example, use the inventive apparatus as a body pillow, while, at the same time, using a separate neck pillow for additional support and alignment. Indeed, the inventive apparatus also does not interfere with the use of a blanket. For example, a user may use a blanket in substantially the same way with or without the inventive apparatus. Moreover, a user may easily use a specially designed cover or a pillow case in conjunction with the inventive apparatus, thereby making it easier to clean the inventive apparatus.

BRIEF DESCRIPTION OF THE DRAWING FIGURES

The accompanying drawings illustrate several embodiments and, together with the description, serve to explain the principles of the invention according to the embodiments. It will be appreciated by one skilled in the art that the particular arrangements illustrated in the drawings are merely exemplary and are not to be considered as limiting of the scope of the invention or the claims herein in any way.

FIG. 1 illustrates, in accordance to one embodiment of the invention, a user using one exemplary embodiment of the inventive apparatus in one exemplary manner.

FIG. 2*a* illustrates one exemplary embodiment of the inventive apparatus from a top perspective view.

FIG. 2*b* illustrates one exemplary embodiment of the inventive apparatus from a bottom perspective view.

DETAILED DESCRIPTION

The inventor has conceived, and reduced to practice, an assistive apparatus for side sleepers, wherein the apparatus improves the alignment of a user's spine and reduces traction and/or compression of the neurovascular and soft tissue elements around the user's shoulders, spine, and arms by distributing and reducing downward pressure on various portions of a user's upper body while the user is sleeping on his or her side while using the apparatus.

Figure 2A:
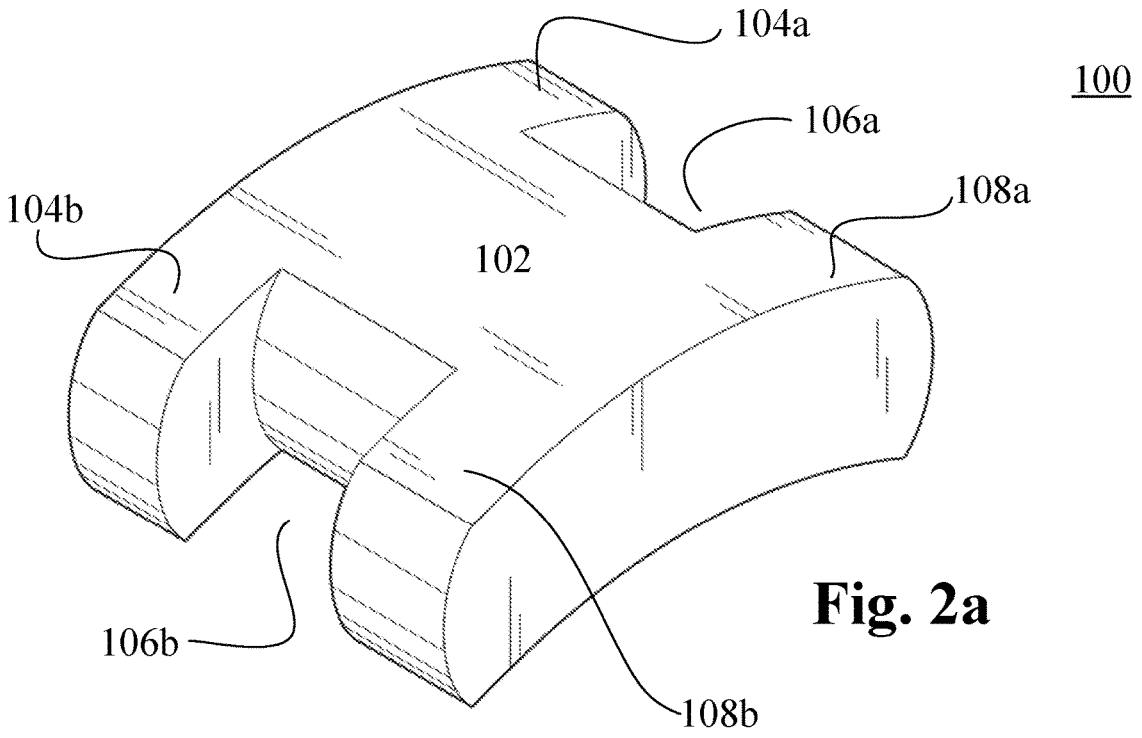
Figure 2B:
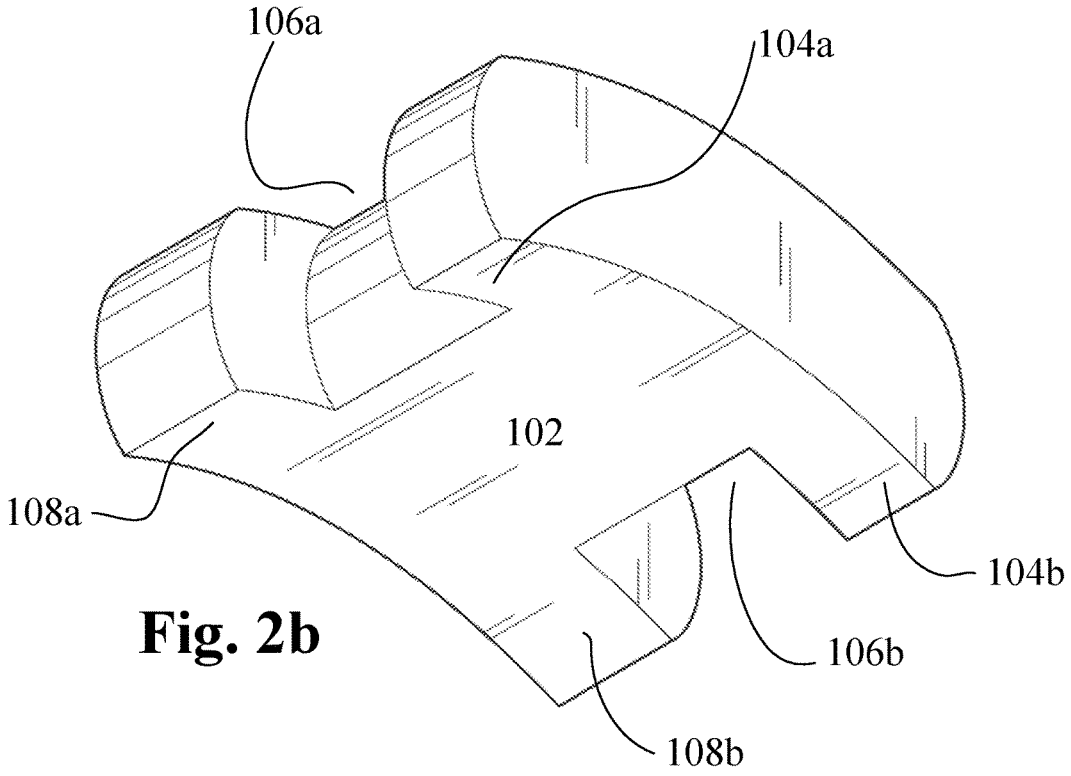

FIGS. 2*a* and 2*b* illustrate one exemplary embodiment of the inventive apparatus 100. It is comprised of a central support element 102, a first shoulder support element 104*a*, a second shoulder support element 104*b*, a first opening 106*a*, a second opening 106*b*, a first mid-torso support element 108*a*, and a second mid-torso support element 108*b*. The various elements help reduce the pressure on a user's shoulder and improve spinal alignment as described in greater detail below.

It should be noted, however, that although the various elements of the inventive apparatus are described separately below, the elements need not necessarily be separate. The various embodiment may be interconnected and may be cut out of a singular block or mold. The variety of different ways of forming an inventive apparatus, in accordance with the disclosure herein, may be varied without departing from the scope of the invention. In one embodiment, for example, wherein the inventive apparatus is comprised of a foam material, the inventive apparatus may be cut from one or more blocks of foam. In another embodiment, various foam pieces may be attached together to create the inventive apparatus 100.

Generally, one or more different embodiments may be described in the present application. Further, for one or more of the embodiments described herein, numerous alternative arrangements may be described; it should be appreciated that these are presented for illustrative purposes only and are not limiting of the embodiments contained herein or the claims presented herein in any way. One or more of the arrangements may be widely applicable to numerous embodiments, as may be readily apparent from the disclosure. In general, arrangements are described in sufficient detail to enable those skilled in the art to practice one or more of the embodiments, and it should be appreciated that other arrangements may be utilized and that structural changes may be made without departing from the scope of the embodiments. Particular features of one or more of the embodiments described herein may be described with reference to one or more particular embodiments or figures that form a part of the present disclosure, and in which are shown, by way of illustration, specific arrangements of one or more of the aspects. It should be appreciated, however, that such features are not limited to usage in the one or more particular embodiments or figures with reference to which they are described. The present disclosure is neither a literal description of all arrangements of one or more of the embodiments nor a listing of features of one or more of the embodiments that must be present in all arrangements.

Headings of sections provided in this patent application and the title of this patent application are for convenience only and are not to be taken as limiting the disclosure in any way.

Devices and parts that are connected to each other need not be in continuous connection with each other, unless expressly specified otherwise. In addition, devices and parts that are connected with each other may be connected directly or indirectly through one or more connection means or intermediaries.

A description of an aspect with several components in connection with each other does not imply that all such components are required. To the contrary, a variety of optional components may be described to illustrate a wide variety of possible embodiments and in order to more fully illustrate one or more embodiments. Similarly, although process steps, method steps, or the like may be described in a sequential order, such processes and methods may generally be configured to work in alternate orders, unless specifically stated to the contrary. In other words, any sequence or order of steps that may be described in this patent application does not, in and of itself, indicate a requirement that the steps be performed in that order. The steps of described processes may be performed in any order practical. Further, some steps may be performed simultaneously despite being described or implied as occurring non-simultaneously (e.g., because one step is described after the other step). Moreover, the illustration of a process by its depiction in a drawing does not imply that the illustrated process is exclusive of other variations and modifications thereto, does not imply that the illustrated process or any of its steps are necessary to one or more of the embodiments, and does not imply that the illustrated process is preferred. Also, steps are generally described once per aspect, but this does not mean they must occur once, or that they may only occur once each time a process, or method is carried out or executed. Some steps may be omitted in some embodiments or some occurrences, or some steps may be executed more than once in a given aspect or occurrence.

When a single device or article is described herein, it will be readily apparent that more than one device or article may be used in place of a single device or article. Similarly, where more than one device or article is described herein, it will be readily apparent that a single device or article may be used in place of the more than one device or article.

The functionality or the features of a device may be alternatively embodied by one or more other devices that are not explicitly described as having such functionality or features. Thus, other embodiments need not include the device itself.

Techniques and mechanisms described or referenced herein will sometimes be described in singular form for clarity. However, it should be appreciated that particular embodiments may include multiple iterations of a technique or multiple instantiations of a mechanism unless noted otherwise. Alternate implementations are included within the scope of various embodiments in which, for example, functions may be executed out of order from that shown or discussed, including substantially concurrently or in reverse order, depending on the functionality involved, as would be understood by those having ordinary skill in the art.

Central Support Element

Referring now to FIGS. 2*a* and 2*b*, as illustrated in accordance with one exemplary embodiment of the invention, the central support element 102 extends the entire length of the apparatus. In another embodiment, the central support element 102 may extend to the shoulder support elements 104*a* and 104*b* on one side, and mid-torso support elements 108*a* and 108*b* on the other side, thereby connecting the elements together. In one aspect, when the inventive apparatus 100 is placed against a user's torso in the manner described above, the central support element 102 may extend from a user's upper torso to the user's mid-torso.

In one instance, the central support element 102 acts as a weight bearing beam that absorbs and redistributes the weight from a user's arm, torso, and upper body, thereby reducing pressure on the user's shoulders, spine, torso, and hip. As such, the central support element 102 helps improve spinal alignment as well by supporting a user's entire upper body.

Shoulder Support Element(s)

Referring again to FIG. 2, as illustrated in accordance with one exemplary embodiment, the inventive apparatus 100 may include one or more shoulder support elements 104. In the particular embodiment illustrated in FIGS. 2*a* and 2*b*, the inventive apparatus is comprised of a first shoulder support element 104*a*, and a second shoulder support element 104*b*. However, it other embodiments, one or more shoulder support element may be used. In one exemplary embodiment, the shoulder support elements 104*a* and 104*b* extend beyond the width of the central support element 102. For example, in an instance that a user is using the inventive apparatus in accordance with the description provided herein, if the width of the central support element 102 extends to a user's mid-clavicular line, then, in that instance, the shoulder support elements 104*a* and 104*b* would extend beyond the mid-clavicular line and to the two lateral borders of the user's shoulders. In other words, the shoulder support elements 104*a* and 104*b* extend the width of a user's upper torso. In one embodiment, the shoulder support elements 104*a* and 104*b* are substantially perpendicular to the central support element 102. However, in other embodiments, the shoulder support elements 104*a* and 104*b* may form other angles with the central support element 102.

The shoulder support elements 104*a* and 104*b* support the user's shoulder by reducing pressure on them and aligning them appropriately. In one instance, the shoulder support elements 104*a* and 104*b* brace the shoulders, and absorb and redistribute some of the weight that would normally be applied to a user's shoulder and spine when the user sleeps in a side position. This feature of the inventive apparatus 100 reduces the downward compression of the shoulders, which, if left unaddressed, may cause misalignment of the cervicothoracic spine and may result in traction and/or compression of the neurovascular and soft tissue elements around the user's upper body.

Mid-Torso Support Element(s)

Referring again to FIGS. 2*a* and 2*b*, as illustrated in accordance with an exemplary embodiment, the inventive apparatus 100 includes two mid-torso support elements 108*a* and 108*b*. In the particular embodiment illustrated in FIGS. 2*a* and 2*b*, the inventive apparatus is comprised of a first mid-torso support element 108*a*, and a second mid-torso support element 108*b*. However, in other embodiments, one or more mid-torso support elements may be used. In one exemplary embodiment, the mid-torso support elements 108*a* and 108*b* extend beyond the width of the central support element 102. For example, in an instance that a user is using the inventive apparatus in accordance with the description provided herein, if the width of the central support element 102 extends to the central portion of a user's mid-torso, then, in that instance, the mid-torso support elements 108*a* and 108*b* would extend beyond the central portion of a user's mid-torso to the two lateral borders of the user's torso. In other words, the mid-torso support elements 108*a* and 108*b* extend the width of a user's mid-torso.

In one embodiment, the mid-torso support elements 108*a* and 108*b* are substantially perpendicular to the central support element 102. However, in other embodiments, the mid-torso support elements 108*a* and 108*b* may form other angles with the central support element 102. In one embodiment, the mid-torso support elements 108*a* and 108*b* are substantially parallel to the shoulder support elements 104*a* and 104*b*.

The mid-torso support elements 108*a* and 108*b* support a user's mid-torso, spine, hips, and shoulders by reducing pressure on these areas and aligning them appropriately. For example, the mid-torso support elements 108*a* and 108*b* help redistribute the weight of the user's torso across the inventive apparatus 100, thereby reducing the pressure on a user's spine. The mid-torso support elements 108*a* and 108*b* of the inventive apparatus 100 reduce the downward compression of the torso, which, if left unaddressed, may cause misalignment of the cervicothoracic spine and may result in traction and/or compression of the neurovascular and soft tissue elements around the user's upper body.

In one embodiment of the invention, the shoulder support elements 104*a* and 104*b* extend beyond the mid-torso support elements 108*a* and 108*b* to ensure that a user's upper body remains supported and aligned while using the inventive apparatus. Generally, users' shoulders tend to be broader than users' mid-torso. Thus, the asymmetry in the inventive apparatus 100 ensures a comfortable ergonomic position and corresponds to the typical shape of the human body. However, in other embodiments, the mid-torso support elements 108 may be broader or of the same width as the shoulder support elements 104

In one embodiment of the invention, the shoulder support elements 104*a* and 104*b* may be thicker, or more reinforced than the mid-torso support elements 108*a* and 108*b*. Generally, when a user sleep on the side, the user's shoulders may experience greater pressure than his or her mid-torso. The specific embodiment disclosed herein permits the inventive apparatus 100 to brace the shoulder more than the mid-torso, thereby improving the ergonomics of the inventive apparatus 100.

Opening(s)

In one exemplary embodiment of the invention, the first shoulder support element 104*a* and the first mid-torso support element 108*a* are spaced apart enough to create a first opening 106*a*. The embodiment illustrated in FIGS. 2*a* and 2*b*, illustrate two openings: a first opening 106*a* that is created in the space between a first shoulder support element 104*a* and a first mid-torso support element 108*a*, and a second opening 106*b* that is created in the space between a second shoulder support element 104*b* and a second mid-torso support element 108*b*. However, in certain embodiments, only a single opening 106, for a single arm, may be created. In addition, in one exemplary embodiment of the invention, the openings 106*a* and 106*b* are large enough to accommodate a user's arms.

Figure 1:
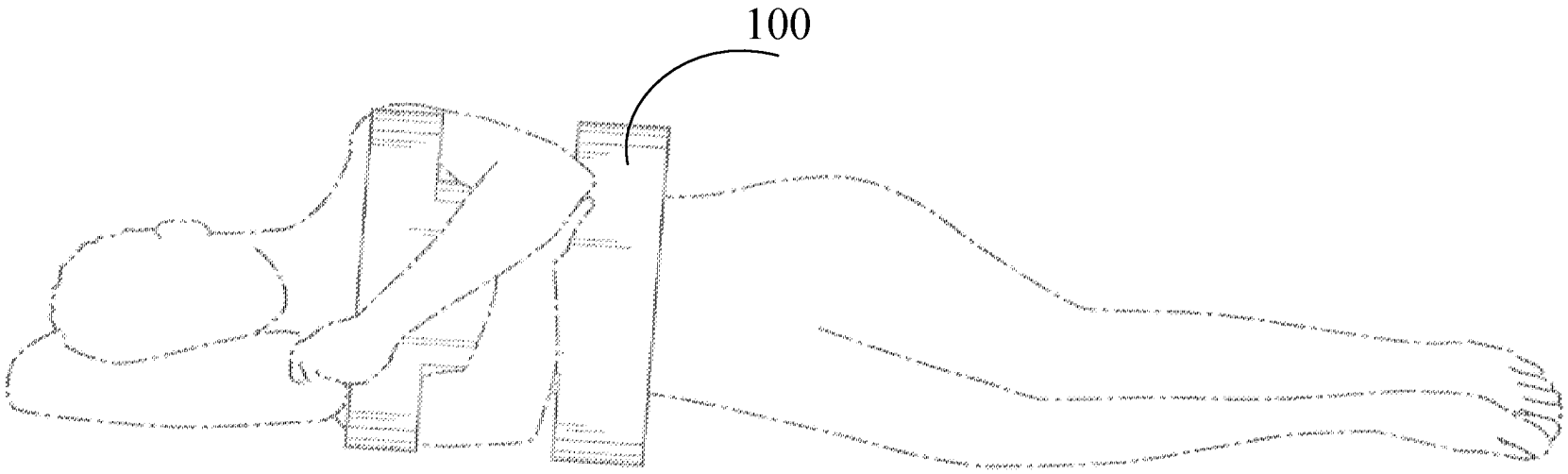

The openings 106*a* and 106*b* permit a user to slide his or her arms through each one of the openings 106*a* and 106*b* and leave them there while in a side sleeping position, as illustrated in FIG. 1. The openings 106*a* and 106*b* improve the neurovascular circulation in a user's arm during the time that the user sleeps on his or her side by creating a space for the user's arms and reducing pressure on them. Typically, when a user sleeps on his or her side, the entire weight of the user's upper body falls on the user's inferior arm, which often gets pinched between the user's body and the sleeping surface. The openings 106*a* and 106*b* address this problem by permitting a user to slide his or her arms through the openings 106*a* and 106*b* thereby reducing pressure that would otherwise be placed on the user's inferior arm.

In addition to the orthopedic function, the openings 106*a* and 106*b* also serve an ergonomic function. Generally, the openings 106*a* and 106*b* make it more comfortable for a user to sleep on his or her side, by, for example, guiding the user's arms in an ergonomic position that corresponds to the location of the openings 106*a* and 106*b*. In one embodiment, a user may flip (or rotate a 180 degrees) the inventive apparatus 100 accommodate additional arm positions. Moreover, the openings 106*a* and 106*b* do not reduce or impair the range of motion that may be generally available to a user via the user's arms and hands. For example, a user may use his or her hands and arms to hold something, or to push off the bed, etc.

Curved Surfaces

Figure 3:
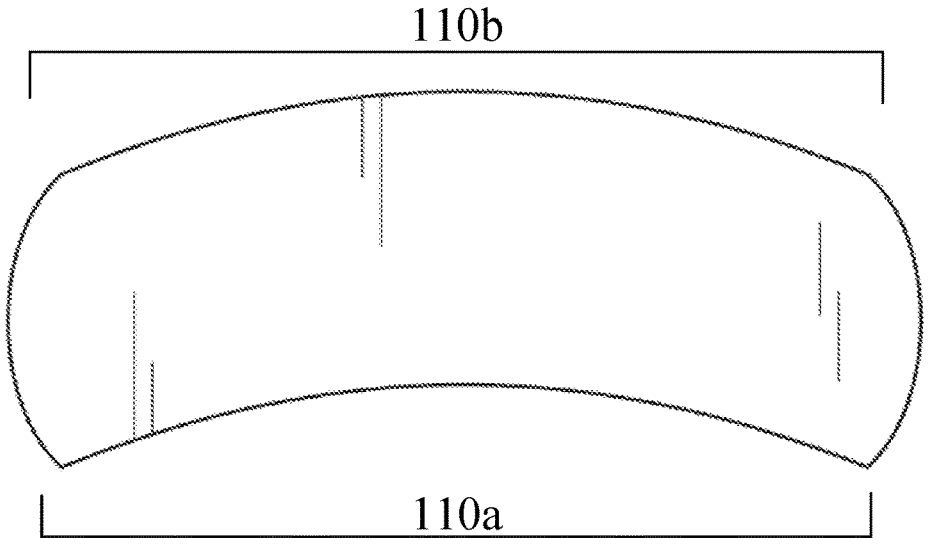
FIG. 3 illustrates one exemplary embodiment of the inventive apparatus from a top plan view.
Figure 4:
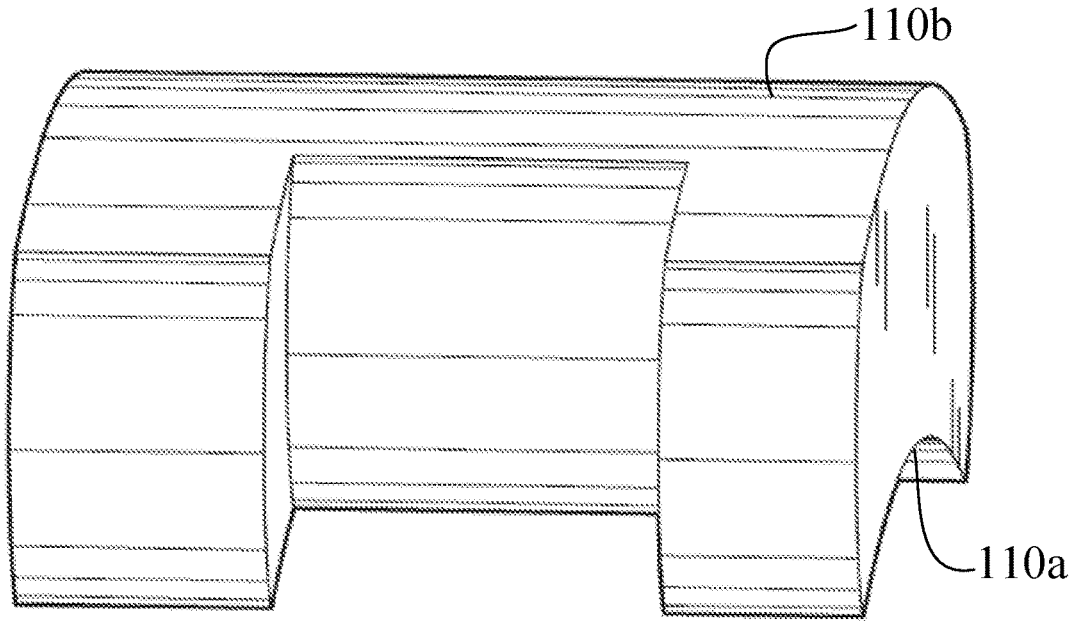
FIG. 4 illustrates one exemplary embodiment of the inventive apparatus from a side perspective view.

FIGS. 3 and 4 illustrate a first curved surface 110*a* and a second curved surface 110*b* that may be used on the exterior portion of the inventive apparatus 100. In one exemplary method of use, the first curved surface 110*a* may be placed against a user's torso, and the second curve surface may be oriented away from the user. The two curved surfaces 110*a* and 110*b* may have a variety of different angles of curvature without departing from the scope of the invention. Moreover, the first curved surface 110*a* may be concave, while the second curved surface 110*b* may be convex. However, in other embodiments of the invention, either or both of the curved surfaces may be convex and/or concave.

The curved surfaces 110*a* and 110*b*, individually and collectively, make the inventive apparatus more comfortable and user friendly. Generally, as illustrated in FIGS. 3 and 4, the first curved surface 110*a* accommodates a variety of different user body types. Moreover, when the first curved surface 110*a* is placed against a user's torso, the first curved surface 110*a* ensures that the inventive apparatus is comfortable and does not press uncomfortably against the user's torso. The second curved surface 110*b* generally faces away from the user when the inventive apparatus is used in the manner described herein. It enables, and facilitates a user to roll from one side sleeping position to an opposite side sleeping position without having to readjust or remove the inventive apparatus.

What is claimed is:

1. A sleep aid apparatus comprising:

a central support element;

a first shoulder support element extending beyond the central support element;

a first mid-torso support element extending beyond the central support element, wherein, the first shoulder support element and the first mid-torso support elements are spaced apart from each other creating an opening, between the first shoulder support element and the first mid-torso support element, wherein the opening is sized and shaped for allowing a user's arm to be positioned in the opening while using the apparatus, a second shoulder support element extending from the central support element in an opposite but substantially parallel direction from the first shoulder support element, and a second mid-torso support element extending from the central support element in an opposite but substantially parallel direction from the first mid-torso support element, wherein the second shoulder support element and the second mid-torso support elements are spaced apart from each other creating a second opening, between the second shoulder support element and the second mid-torso support element, through which a user may slide his or her second arm while using the apparatus, wherein the first shoulder support element extends further from the central support element than the first mid-torso support element, and the second shoulder support element extends further from the central support element than the second mid-torso element, wherein the central support element, the first shoulder support element, the first mid-torso support element, the second shoulder support element, and the second mid-torso support element are formed from a foam block cut into a curved shape having a concave front surface and a convex back surface, wherein the concave front surface is configured to fit against a user's torso, and wherein the convex back surface is configured to be oriented away from the user's torso.

2. The apparatus of claim 1, wherein the first shoulder support element is configured to extend from a user's mid-clavicular line to the lateral borders of the user's shoulders.

3. The apparatus of claim 1, wherein the first shoulder support element and the second shoulder support element are configured to extend from a user's mid-clavicular line to the lateral borders of the user's shoulders.

4. The apparatus of claim 1, wherein the first shoulder support element and the second shoulder support element are configured to extend from a user's mid-clavicular line to the lateral borders of the user's shoulders.

5. The apparatus of claim 1, wherein the first shoulder support element is narrower than the first mid-torso support element.

6. The apparatus of claim 1, wherein the first shoulder support element is narrower than the first mid-torso support element, and the second shoulder support element is narrower than the second mid-torso support element.

7. A method for sleeping in a side-sleeping position with a sleep aid apparatus, the method comprising:

placing the sleep aid apparatus against one's upper body, the sleep aid apparatus comprising a central support element, a first shoulder support element extending beyond the central support element, a first mid-torso support element extending beyond the central support element, wherein, the first shoulder support element and the first mid-torso support elements are spaced apart from each other creating a first opening between the first shoulder support element and the first mid-torso support element, a second shoulder support element extending from the central support element in an opposite but substantially parallel direction from the first shoulder support element, and a second mid-torso support element extending from the central support element in an opposite but substantially parallel direction from the first mid-torso support element, wherein the second shoulder support element and the second mid-torso support elements are spaced apart from each other creating a second opening, between the second shoulder support element and the second mid-torso support element, through which a user may slide his or her second arm while using the apparatus, wherein the first shoulder support element extends further from the central support element than the first mid-torso support, and the second shoulder support element extends further from the central support element than the second mid-torso support element, wherein the central support element, the first shoulder support element, the first mid-torso support element, the second shoulder support element, and the second mid-torso support element are formed from a foam block cut into a curved shape having a concave front surface and a convex back surface, wherein the concave front surface is configured to fit against a user's torso, and wherein the convex back surface is configured to be oriented away from the user's torso;

placing an arm through the first opening; and laying down in a side sleeping position.

* * * * *